United States Patent [19]

Rothaar et al.

[11] Patent Number: 4,923,373

[45] Date of Patent: May 8, 1990

[54] HYDRAULIC SINGLE PISTON PUMP FOR MANUAL OPERATION

[75] Inventors: Stefan Rothaar, St. Wendel; Otfried Stuck, St. Ingbert, both of Fed. Rep. of Germany

[73] Assignee: Flutec Fluidtechnische Gerate GmbH, Fed. Rep. of Germany

[21] Appl. No.: 276,321

[22] PCT Filed: Mar. 31, 1988

[86] PCT No.: PCT/DE88/00211

§ 371 Date: Nov. 21, 1988

§ 102(e) Date: Nov. 21, 1988

[87] PCT Pub. No.: WO88/07495

PCT Pub. Date: Oct. 6, 1988

[30] Foreign Application Priority Data

Apr. 1, 1987 [DE] Fed. Rep. of Germany ..... 3710919

[51] Int. Cl.[5] ..... F04B 21/04; F04B 31/00

[52] U.S. Cl. ..... 417/439; 417/330; 417/302; 417/440; 417/545

[58] Field of Search ..... 417/300, 302, 311, 439, 417/440, 441, 460, 468, 545; 91/422; 92/181 P

[56] References Cited

U.S. PATENT DOCUMENTS

| | | | |
|---|---|---|---|
| 3,112,705 | 12/1963 | Chlebowski | 417/214 |
| 4,357,798 | 11/1982 | Hung | 417/468 |
| 4,520,908 | 6/1985 | Carpenter | 91/422 |

FOREIGN PATENT DOCUMENTS

| | | |
|---|---|---|
| 2131802 | 1/1983 | Fed. Rep. of Germany . |
| 2560938 | 9/1988 | France . |

*Primary Examiner*—Leonard E. Smith
*Assistant Examiner*—John A. Savio, III
*Attorney, Agent, or Firm*—Roylance, Abrams, Berdo & Goodman

[57] ABSTRACT

A hydraulic single piston pump for manual operation has a piston (3) with a first channel (14, 20) running from piston chamber (7) to the rod chamber (5). The first channel has a check valve (15–19) opening in the return stroke. The piston (3) also has at least one second channel (22, 23, 25) running from the piston chamber (7) to the rod chamber (5). The second channel is configured as a choke bore (23, 25) along at least a part of its length.

10 Claims, 1 Drawing Sheet

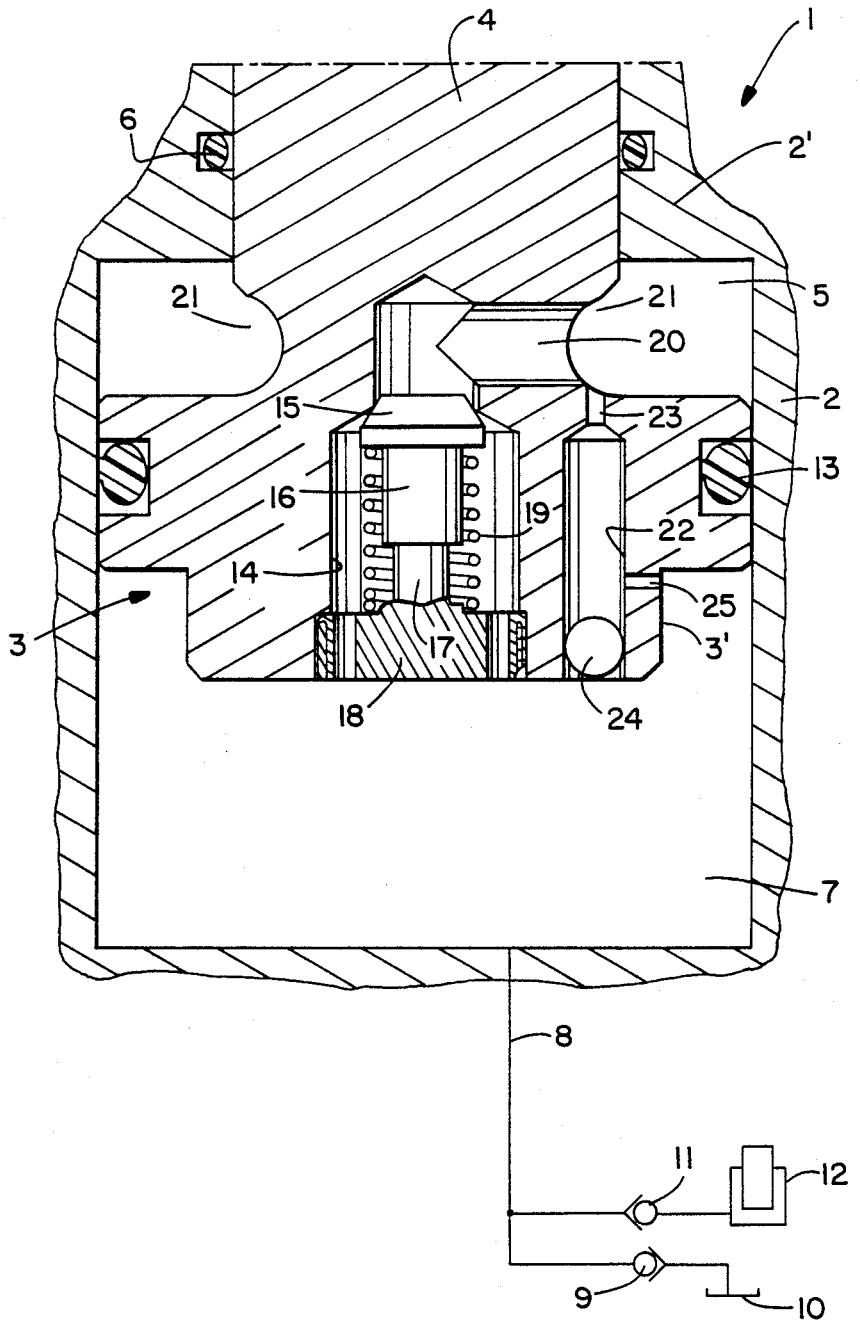
1
2
2'
3
3'
4
5
6
7
8
9
10
11
12
13
14
15
16
17
18
19
20
21
21
22
23
24
25

HYDRAULIC SINGLE PISTON PUMP FOR MANUAL OPERATION

FIELD OF THE INVENTION

The present invention relates to a hydraulic single piston pump for manual operation having a cylinder, a piston dividing the cylinder into a piston chamber and a rod chamber and movable power stroke and in a return stroke, and first and second channels extending through the piston from the piston chamber to the rod chamber. A check valve controls fluid flow through the first channel and opens during the return stroke.

BACKGROUND OF THE INVENTION

According to known manual pumps of this type, the passage of hydraulic fluid through the second channel is automatically controlled by means of a control valve in this second channel. The valve in the second channel opens at the beginning of each power stroke when the predetermined level of pressure in the piston chamber is exceeded, so that pressure compensation occurs continuously between the piston chamber and the rod chamber. The effective pump surface is thereby reduced to the size of the rod surface. The force being exerted on the piston with the power stroke is then automatically reduced as soon as the aforementioned limit value is exceeded. Because of this, the use of a two-stage pump has been recently discussed, which can be used in lift trucks, whereby the loads are to be lifted with as few as possible pump cycles.

SUMMARY OF THE INVENTION

The object of the present invention is to improve a single piston pump of the aforementioned type.

This object is attained by means of a hydraulic single piston pump for manual operation, comprising a cylinder, and a piston dividing the cylinder into a piston chamber and a rod chamber. The piston is movable to decrease the piston chamber in a power stroke and to increase the piston chamber in a return stroke. A first channel extends through the piston from the piston chamber to the rod chamber. A check valve is in and controls fluid flow through the first channel, and opens during the return stroke of the position. A second channel extends through the piston from the piston chamber to the rod chamber. The second channel has means for automatically controlling hydraulic fluid flow from the piston chamber to the rod chamber dependent on differential pressures in the chambers. The means includes a first choke bore along at least part of a length of the second channel.

The choke bore in the second channel reduces the costs of operation. It also leads to a reduced susceptibility to the incidence of trouble, even under rough operating conditions, and allows for a lower overall height of the pump. Above all, the choke bore leads to the condition wherein the power to be applied during the power stroke is dependent upon the velocity of operation, i.e., the pump velocity. Instead of a reversal of the effective piston surface outlay occurring when the predetermined limit value of the pressure in the piston chamber is exceeded or is not reached, which cannot be influenced by the user, in the pump according to the present invention, the user can adapt the operational power to be exerted on the piston to its entire possible range within the limits determined by the complete piston cross section and the reduced piston cross section, independent of the pressure in the piston chamber.

If, during the power stroke, the piston moves sufficiently slowly that complete pressure compensation between the piston chamber and the rod chamber is attained, the effective piston surface is the same as the rod surface, independent of influence exerted by the pressure level in the piston chamber. The more rapid the movement of the piston during power stroke, the greater remains the pressure differential between piston chamber and rod chamber. When the pump according to the present invention is associated for instance with a lift truck, any load independent of its size can be conveyed by ever greater pump velocity, which indeed also requires a higher power outlay, with fewer pump cycles at high velocity rather than with a lower pump velocity.

One further advantage of the solution of the problem according to the present invention is that, with the power stroke taking place in the piston chamber, no vacuum pressure can be created. When the rod packing gasket is not fully functional, this can result in air being sucked in.

With a second channel of only relatively short length, this channel can be constructed along its entire length in a choke bore configuration. Generally speaking, however, the second channel will be longer than the required length of the choke segment. In that case, with the exception of the segment forming the choke bore, the second channel can be constructed with a larger diameter.

It is also possible, as is the case in one preferred embodiment of the invention, to provide two choke bores in series one following the other with some spacing in the train of the second channel. These two choke bores are then connected together by a channel segment of greater diameter. This embodiment is advantageous in functional efficiency and flow technology. For instance, from the point of view of manufacturing costs, it is advantageous that one of the two choke bores be arranged coaxial with the larger diameter segment of the second channel. The second choke bore can then extend coaxially with the first choke bore, but also at an angle to this channel segment.

From the point of view of manufacturing, in one preferred embodiment, the larger diameter channel segment extends from the surface of the piston turned toward the piston chamber into this piston. The one choke bore can then be joined coaxially to the end lying in the piston. The other choke bore can be provided in an enclosing member which shuts off the beginning of this channel segment at the piston front surface by its placement penetrating the channel segment. Alternatively, it is possible to allow the second choke bore to open into the channel between the enclosing member and the other choke segment, for instance, from the generated surface of the piston.

Other objects, advantages and salient features of the present invention will become more apparent from the following detailed description, which, taken in conjunction with the annexed drawings, discloses a preferred embodiment of the present invention.

BRIEF DESCRIPTION OF THE DRAWINGS

Referring to the drawing which forms a part of this disclosure, the sole figure is a side elevational view in section of a hydraulic piston pump according to the present invention.

DETAILED DESCRIPTION OF THE INVENTION

A hydraulic piston pump 1, which is to be manually operated, has a cylinder 2 in which is arranged a longitudinally movable piston 3. Piston 3 is provided at the one end of a piston rod 4 guided longitudinally movably in a slideway 2'. Slideway 2' is joined with the end of cylinder 2 limiting the rod chamber 5. Piston rod 4 is packed in slideway 2' by means of an 0-ring 6. Piston chamber 7 is separated from rod chamber 5 by piston 3, and is connected through a connection line 8 and a first check valve 9 with a tank 10 and through a second check valve 11 with a working cylinder 12, for example, for the working cylinder of a lift truck. The piston gasket engaging on the inside wall of the cylinder is configured as an 0-ring 13. 0-ring 13 lies in an annular groove in piston 3.

On the side of piston chamber 7, the piston has a central projecting portion 3'. The outside diameter of the projecting portion is smaller than the portion of the piston adapted to the inside diameter of cylinder 3, but is greater than the diameter of piston rod 4.

A pocket bore 14 penetrates the piston from the center of the surface of piston 3 limiting piston chamber 7. Bore 14 forms an annular shoulder at some distance from its end portion penetrating into piston rod 4. The shoulder forms a seat for a spring-biased valve member 15 functioning as a check valve. This valve member 15 is arranged at one end of a guide sheathing 16, which sheathing rests longitudinally movably on a guide journal 17. Guide journal 17 is at some distance from an orifice plate swage block 18. Block 18 is screwed into the front segment of pocket bore 14. A compression spring 19 surrounds guide sheathing 16 and guide journal 17, is supported on orifice plate swage block 18 and encumbers or biases valve member 15 with the required force. A transverse bore 20 opens into the end portion of pocket bore 14 lying in piston rod 4, and penetrates the piston from an annular fillet 21 provided at the connection between piston rod 4 to piston 3. Bore 20 extends at the right angle to the longitudinal axis of piston rod 4. The prebiasing of compression spring 19 is selected and set so that with even a relatively slight pressure in piston chamber 5 during the piston return stroke, the check valve is opened and the hydraulic fluid can flow into piston chamber 7.

Parallel to the longitudinal axes of piston 3 and piston rod 4, but at some distance from the longitudinal axes, a distance which is somewhat greater than half the diameter of annular fillet 21 measured at the bottom of the fillet, a bore 22 penetrates the piston from the front surface of piston 3 defining piston chamber 7. Bore 22 ends at some distance from annular fillet 21. The diameter of bore 22, as shown in the drawing, is considerably greater than that of the first choke bore 23. The axial length of bore 22 is a multiple of the axial length of the first choke bore 23. The beginning of bore 22 is shut and sealed by means of a sealing member 24.

In the exemplary embodiment, this sealing member is a ball pressed into the beginning segment of bore 22. A second choke bore 25 opens, between sealing member 24 and first choke bore 23, into bore 22 at a right angle to bore 22. At its other end, second choke bore 25 opens into the generating surface of projecting portion 3'.

The cross sections of the two choke bores 23 and 25, as well as their lengths, are selected so that with a power stroke of piston 3 at relatively great velocity, the choking effect is sufficiently strong that only very little hydraulic fluid can pass from piston chamber 7 into rod chamber 5. On the other hand, with a relatively low velocity of movement of piston 3, a considerable degree of pressure compensation occurs between piston chamber 7 and rod chamber 5. The diameter of bore 22 is considerably greater than that of choke bores 23 and 25, so that the segment lying between the two choke bores is not subjected to the effect of the chokes.

While a particular embodiment has been chosen to illustrate the invention, it will be understood by those skilled in the art that various changes and modifications can be made therein without departing from the scope of the invention as defined in the appended claims.

We claim:

1. A hydraulic single piston pump for manual operation, comprising:

a cylinder with an inlet and an outlet;

a piston dividing said cylinder into a piston chamber and a rod chamber and being movable to decrease said piston chamber in a power stroke and to increase said piston chamber in a return stroke;

a first channel extending through said piston from said piston chamber to said rod chamber;

a check valve in and controlling fluid flow through said first channel, said check valve opening during the return stroke of said piston; and a second channel extending through said piston from said piston chamber to said rod chamber, said second channel having means for automatically controlling hydraulic fluid flow from said piston chamber to said rod chamber dependent on differential pressures in said chambers, said means including a first choke bore along at least as part of a length of said second channel.

2. A hydraulic single piston pump according to claim 1 wherein said means comprises a second choke bore in series with and spaced from said first choke bore in said second channel.

3. A hydraulic single piston pump according to claim 2 wherein said first and second choke bores are connected by a channel segment having a greater transverse diameter than transverse diameters of said choke bores.

4. A hydraulic single piston pump according to claim 3 wherein said channel segment is coaxial with said first choke bore.

5. A hydraulic single piston pump according to claim 4 wherein said first and second choke bores are oriented at an angle.

6. A hydraulic single piston pump according to claim 5 wherein said angle is a right angle.

7. A hydraulic single piston pump according to claim 4 wherein said channel segment comprises a bore opening on and extending from a piston surface facing said piston chamber, said bore having a first end adjacent said piston chamber receiving a sealing member and a second end adjacent said rod chamber forming said first choke bore.

8. A hydraulic single piston pump according to claim 7 wherein said second choke bore opens into said channel segment between said sealing member and said first choke bore and into said piston chamber.

9. A hydraulic single piston pump according to claim 1 wherein said second channel does not have a valve therein.

10. A hydraulic single piston pump according to claim 1 said second channel is permanently open.

* * * * *